United States Patent [19]

Perelson

[11] 3,990,278

[45] Nov. 9, 1976

[54] LOCKING ARRANGEMENT

[75] Inventor: Daniel Perelson, Holon, Israel

[73] Assignee: Daniel Perelson, Tel Aviv, Israel

[22] Filed: July 18, 1975

[21] Appl. No.: 596,976

[52] U.S. Cl. ..... 70/120; 70/150

[51] Int. Cl.[2] ..... E05B 63/14

[58] Field of Search ..... 70/118, 120, 134, 150

[56] References Cited

UNITED STATES PATENTS

| | | | |
|---|---|---|---|
| 1,097,902 | 5/1914 | Zappile | 70/120 |
| 2,936,606 | 5/1960 | Welch et al. | 70/150 X |
| 3,222,898 | 12/1965 | Lunsford | 70/120 X |

FOREIGN PATENTS OR APPLICATIONS

| | | | |
|---|---|---|---|
| 515,779 | 12/1952 | Belgium | 70/118 |
| 13,754 | 11/1890 | Germany | 70/118 |
| 190,757 | 10/1907 | Germany | 70/120 |
| 238,080 | 9/1911 | Germany | 70/120 |
| 240,183 | 3/1946 | Switzerland | 70/120 |

*Primary Examiner*—Paul R. Gilliam
*Assistant Examiner*—Carl F. Pietruszka

[57] ABSTRACT

The locking device includes a support having a first plate rotatably mounted thereon. Four radially extending locking bars are rotatably mounted on the first plate such that the rotation thereof moves the bars between locked and unlocked positions. A second plate movably mounted on the support between first and second positions is provided with means engagable with the first plate to prevent the rotation thereof when the second plate is in the first position. A projection is mounted on the lock cylinder and is movable with respect thereto along an arcuate path upon actuation of the cylinder. The projection is engagable with the given portion of the first plate to rotate same as the projection is moved. The second plate has a surface aligned with and adjacent to the given portion of the first plate, this surface and the given portion of the first plate, this surface and the given portion of the first plate intersect the path of movement of the projection such that the projection moves the second plate towards the second position and rotates the first plate substantially simultaneously.

8 Claims, 3 Drawing Figures

LOCKING ARRANGEMENT

The present invention relates to a locking arrangement.

It has been found that the commercial available locks have certain drawbacks and are easily accessible to burglars. This is due to the fact that they are generally provided only with one or two locking bars in such positions that can easily be tampered with and thus broken up.

There is known a locking arrangement as described and claimed in Israel Patent Specification No. 40820 which attempts to overcome the above disadvantage. This locking arrangement comprises more than two elongated locking bars, generally four, whose inner ends are pivotally attached to one surface of a wheel having gear teeth thereon, the wheel being in mesh with and rotatable by a gear mounted on the cylinder of a lock operable by a key from both sides of the door.

Although this locking arrangement has certain improvements when being compared with known locks, it still has certain disadvantages, namely:

a. No means are provided for preventing the rotation of the wheel to which the locking bars are attached by manipulation of the locking bars. Thus, one having access to the end of one of the locking bars can, by the appropriate manipulation of same, move the bar so as to rotate the wheel, thus opening the entire arrangement.

b. The actuation of the wheel by way of a gear being in meshed therewith is not satisfactory. This construction requires an additional part to be mounted on the cylinder, namely the gear. Moreover, the teeth of the wheels which in general are not very long, can easily be broken when the arrangement is tampered with and then the entire arrangement becomes useless.

It is therefore an object of the present invention to design a locking arrangement which overcomes the aforementioned drawbacks for the locking arrangement of Israel Patent Specification No. 40820, but should possess at the same time the advantages thereof. In addition, the arrangement should not be complicated and relatively inexpensive to manufacture and easy to mount on the door, window or the like to be protected therewith.

The present invention thus consists in a locking arrangement which comprises four elongated locking bars at 90° radial distances from each other which bars are pivotally attached to a rotatable plate, said rotatable plate being actuated by a projection extending from a rotatable cylinder of a lock operable by a key from either side of the door, said rotatable plate being in engagement with a second plate positionable to prevent the rotation of the rotatable plate. Both plates are actuated simultaneously by the same instrumentality in the form of the projection mounted on the cylinder. The projection is preferably an integral part of the cylinder as commercially available.

The rotatable plate may be actuated by various means. Thus, for example, the rotatable plate may be provided with some deep teeth, into which the projection of the cylinder is inserted, the projection causing the plate to rotate in order to move the locking bars between the locked and unlocked positions.

Means, in the form of a second movable plate, engagable with the rotatable plate, are provided to prevent the movement of the rotatable plate when the bars are in the locked position such that manipulation of one of the bars will not rotate the plate thereby causing the remaining bars to move to the unlocked position. The second plate is provided with a surface which is in alignment with and adjacent to that portion of the first plate which engages the projection. This surface of the second plate and the portion of the first plate intersect the arcuate path of movement of the projection such that the projection serves to move the second plate to release the rotatable plate and, in addition, rotates the rotatable plate substantially simultaneously.

While the means for preventing rotation of the rotatable plate may take various forms, in the present invention the second plate is a longitudinally movable plate mounted on the support and situated between the rotatable plate and the support.

The second plate is longitudinally movable between a first and a second position. Means are provided on the second plate for operatively engaging the rotatable plate to prevent the rotation thereof when the second plate is in the first position. As illustrated herein, this engaging means takes the form of a pin, extending generally perpendicular to the plane of movement of the second plate, which engages teeth on the rotatable plate to prevent the rotation thereof when the second plate is in the first position. The projection on the cylinder is adapted to move the second plate to the second position to release the rotatable plate to permit rotation thereof. Means, in the form of a spring, are provided in conjunction with the second plate to urge same into the first position. The spring means make it very difficult to attack the lock by moving the pin out of the teeth on the rotatable plate when the second plate is in the first or locked position.

As illustrated herein, the teeth or indentations on the rotatable plate are preferably rather large such that they cannot be easily broken, thus preventing tampering with the lock. In addition, the entire lock is mounted on a base plate which is connected to the door, window or other enclosure which is being locked.

The present invention will now be illustrated with reference to the accompanying drawing without being restricted by them. In these drawings.

Figure 1:
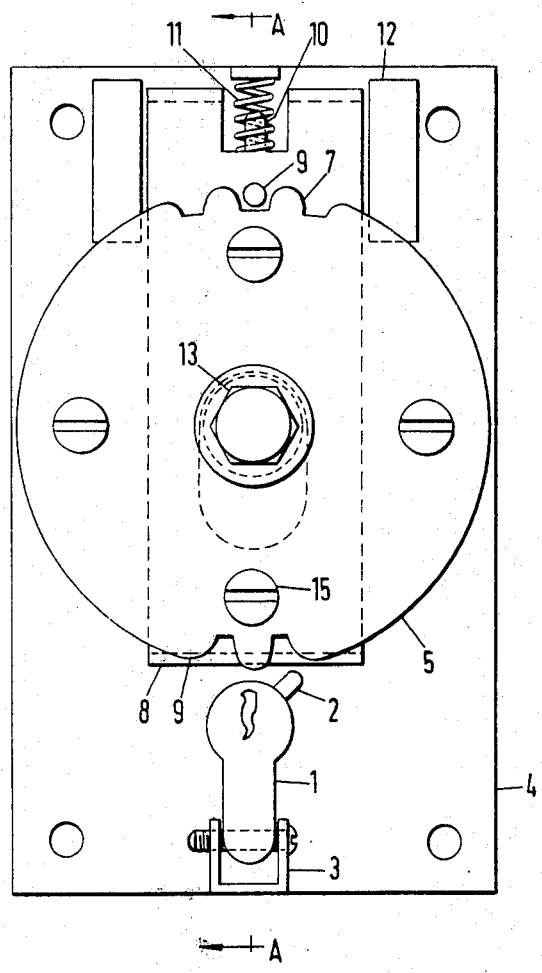
FIG. 1 shows a top view of the locking arrangement according to the present invention.

The locking arrangement illustrated in said FIGS. comprises cylinder 1 being provided with projection 2 movable in an arcuate path. The cylinder is held by bracket 3 fixedly mounted on base plate 4. A rotatable plate 5 is provided with teeth 6 on one side thereof and with teeth 7 on the other side. Below plate 5 extends longitudinal plate 8 movable between a first or locked position and a second or unlocked position. A pin 9 extends from the surface of plate 8 toward plate 5 in the vicinity of teeth 7 and when plate 8 is in the first or locked position, pin 9 engages teeth 7 to prevent the rotation of plate 5. A spring 11 is provided between the support or base plate 4 and longitudinally movable plate 8 at tongue 10 thereon so as to urge plate 8 towards its first or locked position. Rails 12 are provided on support 4 so as to provide a guide for the movement of plate 8. Plates 5 and 8 are secured by screw 13 mounted to base plate 4. Locking bars 14 are connected by screws 15 onto plate 5. Plate 8, at the lower end thereof, is provided with an elongated slot through which screw 13 extends so as to form a moving connection to permit limited longitudinal movement of plate 8 relative to support 4. Plate 8, at the lower end thereof, is provided with a surface which extends generally perpendicular to the plane of movement thereof. This surface is aligned with and adjacent to teeth 6 on rotatable plate 5 such that this surface and teeth 6 intersect the arcuate path of movement of projection 2. In this manner, projection 2, when cylinder 1 is actuated by turning the key, moves the second plate 8 towards the second or unlocked position and rotates the first plate 5 substantially simultaneously. Thus, both plates are actuated simultaneously by the same instrumentality, namely projection 2, and this is accomplished by the engagement of both plates with the projection during a portion of the arcuate path of travel thereof substantially contributing to the simplicity of structure and operation of the locking arrangement of the present invention. (Only one bar 14 and one screw 15 are being marked for sake of clarity). Base plate 4 can be connected to a door or the like by nails, screws, etc. via bores 16. (Only the bore 16 is marked).

Figure 2:
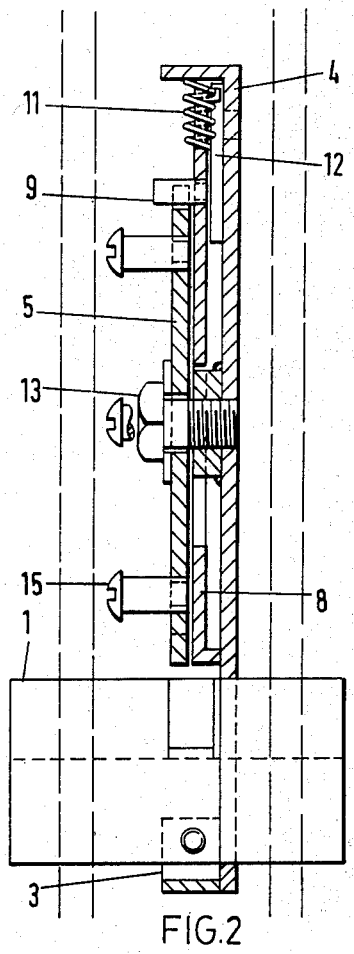
FIG. 2 shows a section along line II—II of FIG. 1.
Figure 3:
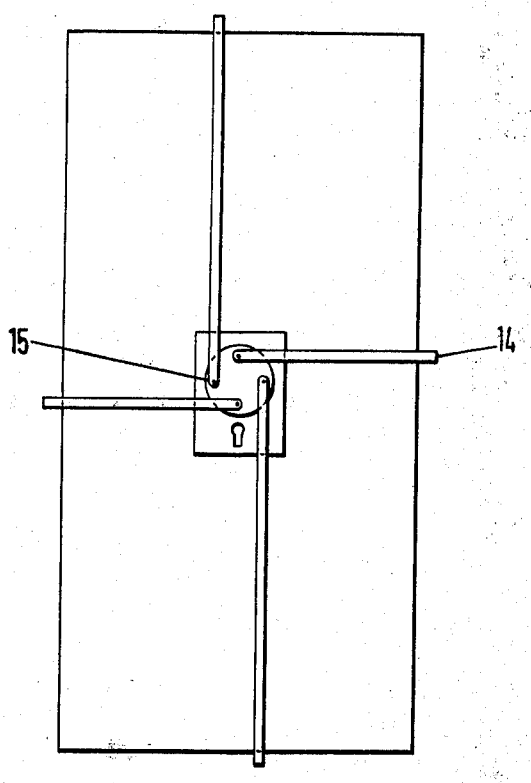
FIG. 3 shows a schematical arrangement of the lock provided with bars.

The above described locking arrangement works as follows:

A key can be inserted into cylinder 1 from either side of the locking arrangement so as to actuate same. Rotation of the key causes projection 2 to move along an arcuate path which intersects both teeth 6 on rotatable plate 5 and the surface on the lower end of longitudinally movable plate 8 on the path of movement thereof. The movement of projection 2 serves to move longitudinally movable plate 8 from the first or locked position, as shown in FIG. 1, towards a second or unlocked position (vertically upward, as seen in FIGS. 1 and 2) thus causing pin 9 to disengage teeth 7 and the compression of spring 11. In addition, the movement of projection 2 also rotates rotatable plate 5 such that the locking bars 14 are moved from the locked to the unlocked position. After the rotation of rotatable plate 5 is complete and projection 2 has moved to a position where it no longer engages plate 8, spring 11 urges plate 8 from its second or unlocked position to its first or locked position such that pin 9 again engages teeth 7 on rotatable plate 5 preventing any further rotation thereof. Thus, if one were to manipulate one of the locking bars 14 by attempting to move same towards rotational plate 5, the engagement of pin 9 with teeth 7 on rotational plate 5 would prevent the rotation of plate 5 and, thus, the movement of the locking bars 14 from the locked to the unlocked position.

It should be appreciated that since the rotatable plate 5 and longitudinally movable plate 8 are both simultaneously actuated by the same instrumentality, projection 2, along the path of movement of the projection, the present invention demonstrates a simplicity of structure not present in prior art locking arrangements of this type. In addition, the present invention provides a locking arrangement which substantially prevents access to the enclosure upon which it is used even if access to one of the locking bars is available because manipulation of one of the locking bars will not cause rotation of the rotatable plate and, thus, the remaining locking bars will not be moved to the unlocked position.

While only a single preferred embodiment of the present invention has been described herein for purposes of illustration, it is obvious that many variations and modifications can be made thereto. It is intended to cover all of these variations and modifications which fall within the scope of the present invention as defined by the following claims.

I claim:

1. A locking device comprising a support, four locking bars extending radially outwardly from said support, a first plate rotatably mounted on said support, means for rotatably mounting said locking bars on said first plate such that rotation of said first plate moves said locking bars between locked and unlocked positions, a second plate movably mounted on said support between first and second positions, means on said second plate engageable with said first plate to prevent the rotation thereof when said second plate is in said first position, a lock cylinder mounted on said support, a projection mounted on said cylinder and movable with respect thereto along a given path upon the actuation of said cylinder, said projection being engageable with a given portion of said first plate to rotate same as said projection is moved, said second plate having a surface thereof aligned with and adjacent to said given portion of said first plate, said surface and said portion intersecting said path such that said projection moves said second plate towards said second position and rotates said first plate substantially simultaneously.

2. The locking arrangement of claim 1 wherein said projection is movable in an arcuate path.

3. The locking device of claim 1 wherein said surface is substantially perpendicular to the movement of said second plate.

4. The locking device of claim 1 wherein said second plate is mounted on said support by means of a moving connection comprised of an elongated slot through which a pin mounted on the support extends.

5. The locking device of claim 4 wherein said first plate is rotatably mounted on said pin.

6. The locking device of claim 1 further comprising spring means adapted to urge said second plate towards said first position.

7. The locking device of claim 1 wherein said cylinder is accessible from both side of said locking device.

8. The locking device of claim 1 wherein said engageable means comprises a pin mounted on the surface of said second plate and extending generally perpendicular to the plane of movement thereof and a plurality of indentations on the periphery of said first plate, said pin, when said second plate is in said first position, engaging one of said indentations, thereby preventing the rotation of said first plate.

* * * * *